US005111505A

United States Patent [19]

Kitoh et al.

[11] Patent Number: 5,111,505

[45] Date of Patent: May 5, 1992

[54] SYSTEM AND METHOD FOR REDUCING DISTORTION IN VOICE SYNTHESIS THROUGH IMPROVED INTERPOLATION

[75] Inventors: Atsunori Kitoh, Yamatotakada; Yoshiji Fujimoto, Nara, both of Japan

[73] Assignee: Sharp Kabushiki Kaisha, Tokyo, Japan

[21] Appl. No.: 598,826

[22] Filed: Oct. 16, 1990

Related U.S. Application Data

[63] Continuation of Ser. No. 381,000, Jul. 17, 1989, abandoned.

[30] Foreign Application Priority Data

Jul. 21, 1988 [JP] Japan ..... 63-183906

[51] Int. Cl.[5] ..... G10L 5/02

[52] U.S. Cl. ..... 381/51

[58] Field of Search ..... 381/36-40, 381/51-53; 364/513.5

[56] References Cited

U.S. PATENT DOCUMENTS

| | | | |
|---|---|---|---|
| 4,214,125 | 7/1980 | Moser et al. | 381/51 |
| 4,392,018 | 7/1983 | Fette | 381/51 |
| 4,419,540 | 12/1983 | Henderson | 381/51 |
| 4,433,434 | 2/1984 | Mozer | 381/51 |
| 4,489,437 | 12/1984 | Fukuichi et al. | 381/51 |
| 4,601,052 | 7/1986 | Saito et al. | 381/51 |
| 4,619,359 | 9/1987 | Morito | 381/51 |

FOREIGN PATENT DOCUMENTS

| | | |
|---|---|---|
| 0081595 | 6/1983 | European Pat. Off. . |
| WO8504747 | 10/1985 | PCT Int'l Appl. . |

OTHER PUBLICATIONS

Yato et al., "Speech Synthesis by the Compililation of Speech Segments (in Japanese)", presented Dec. 18, 1973, at a laboratory of Kokusai Denshin Denwa. This paper contains an English summary.

*Primary Examiner*—Emanuel S. Kemeny
*Assistant Examiner*—Michelle Doerrler
*Attorney, Agent, or Firm*—Merchant, Gould, Smith, Edell, Welter & Schmidt

[57] ABSTRACT

A voice synthesizing device which compiles wave segments, such as pitch wave segments, in order to synthesize speech. Speech is synthesized by connecting wave segments to form a contiguous waveform. Each wave segment is assigned one or more connection types which describe the connection to be made between points on that wave segment and points on adjacent wave segments. A wave segment connector uses information on the connection types of adjacent wave segments to connect the end point and lead point of the adjacent wave segments using a normal sampling period or a normal sampling period compressed or expanded by ½ of the sampling period. The period used depends on the connection type stored in the connection type memory.

11 Claims, 7 Drawing Sheets

(1)

(2)

(3)

(4)

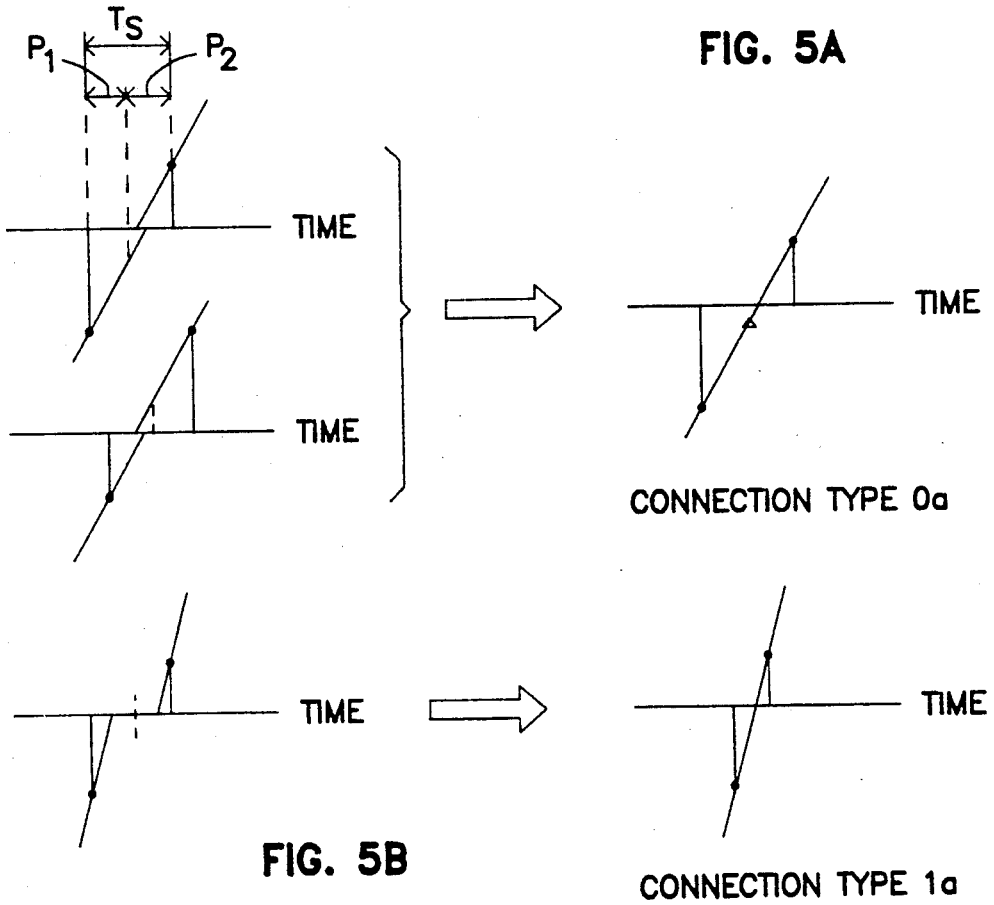
FIG. 5A
FIG. 5B
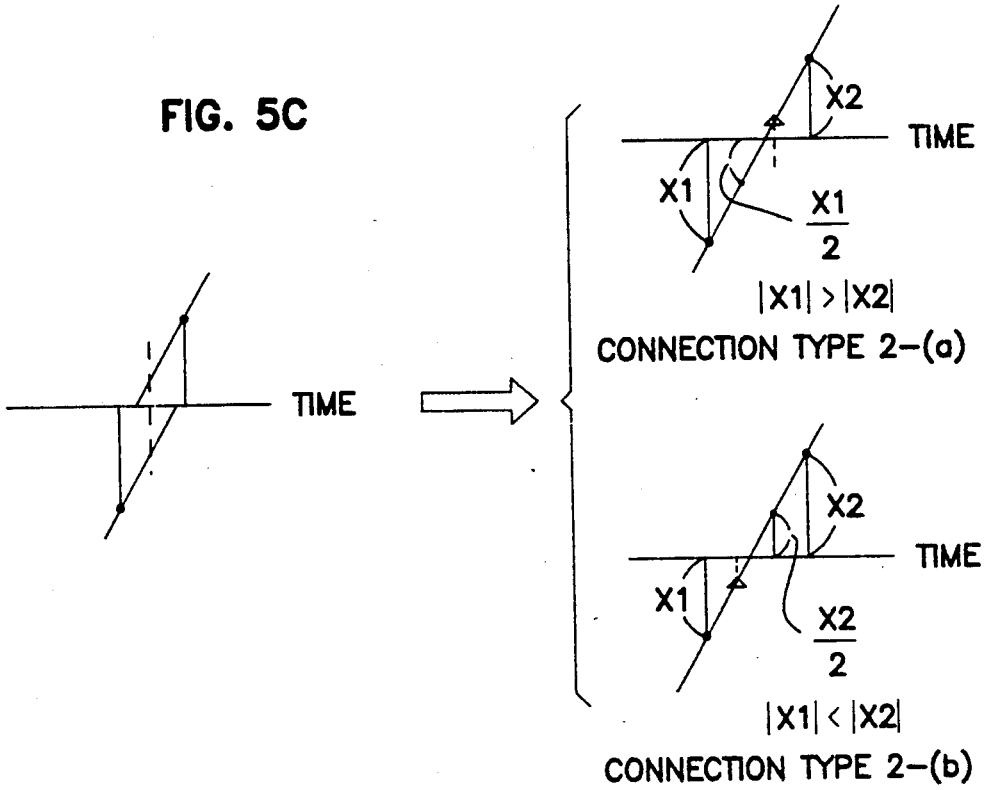
FIG. 5C

SYSTEM AND METHOD FOR REDUCING DISTORTION IN VOICE SYNTHESIS THROUGH IMPROVED INTERPOLATION

This is a continuation of application Ser. No. 07/381,000, filed Jul. 17, 1989, abandoned.

1. Field of the Invention

The present invention relates to a voice synthesizing device which compiles wave segments such as pitch wave segments and quasi-voice wave segments to reproduce a voice wave.

2. Description of the Prior Art

It is well known that of the different voice waves, the waves of voiced sounds such as vowels have a redundant pitch structure in which essentially the same wave is repeated from several to a dozen times within a cycle of from 2 or 3 ms to 10 ms. Conventionally, voice synthesizers have employed a phoneme segment compiling method using the above pitch structure to generate a synthesized voice. Voice synthesizers of this type repeat and connect pitch wave segments or quasi-voice wave segments for a predetermined period to synthesize a voice wave. This serves to reduce the amount of wave segment data for said pitch wave segments or quasi-voice wave segments, and maintains high quality in the eventually synthesized voice.

However, because a conventional voice synthesizer using the segment compiling method as described above synthesizes a voice wave by simply repeating and connecting pitch wave segments or voice wave segments based on said pitch wave segments for a predetermined period, distortion arises where said pitch wave segments or quasi-voice wave segments are connected as described below.

FIG. 4*a* through FIG. 4*d* shows an example of pitch wave segments used in voice waveform synthesis. Each double circle in FIG. 4*a* through 4*d* shows the sampled value at every sampling time (hereafter referred to as a sampled value); the solid lines drawn perpendicular to the time axis from these points represent the sampling time; and the dotted lines drawn perpendicular to the time axis between these sampling points represent the interpolated sampling time at which said sampled value is interpolated to output the interpolated value during the waveform synthesis. The pitch wave segments shown in FIG. 4*a* through FIG. 4*d* may be of one of the following four wave types depending on the position at which the wave crosses the zero point.

Specifically, the sampling time period Ts is divided into two phases, the first referred to as P1 and the later as P2. Thus, in wave type (1) shown in FIG. 4(*a*), zero cross point m for the interpolated waveform of top sampled value of the pitch segment falls within the range P2, and the zero cross point o for the interpolated waveform of the end sampled value of the pitch segment falls within the range P2. In wave type (2) shown in FIG. 4(*b*), the zero cross point for the interpolated waveform of the top or lead sampled value of the pitch segment falls within the range P1, and the zero cross point for the interpolated waveform of the end sampled value of the pitch segment falls within the range P1. In wave type (3) shown in FIG. 4(*c*), the zero cross point for the interpolated waveform of top sampled value of the pitch segment falls within the range P2, and the zero cross point for the interpolated waveform of end sampled value of the pitch segment falls within the range P1. In wave type (4) shown in FIG. 4(d), the zero cross point for the interpolated waveform of top sampled value of the pitch segment falls within the range P1, and the zero cross point for the interpolated waveform of end sampled value of the pitch segment falls within the range P2. Thus, if pitch wave segments of each of the types previously described are simply repeated and connected, the pitch cycle where the segments are connected will be shifted in phase by a quantity equal to half the sampling period, resulting in distortion which differs from the original wave.

In other words, if, for example, like waves of type (3) are simply connected, the phase of the resulting wave will be delayed by one-half sampling cycle as shown in FIG. 5(*b*). Furthermore, if like waves of type (4) are simply connected, the phase of the resulting wave will be advanced by one-half sampling cycle as shown in FIG. 5(*c*). In this event, interference will occur in the rise of the pitch wave segment, and the sound quality of the eventually synthesized voice will significantly deteriorate. The deterioration in sound quality is particularly severe when the pitch period is short (i.e., the pitch frequency is high) as in female voices.

In order to solve the above discussed problem, there are two methods. According to one method, one pitch wave segment is cut out, temporarily converted to a frequency axis wave by fast Fourier transformation (FFT) analysis, and reconverted to a time axis wave by reverse FFT after phase adjustment so that both ends of the pitch wave segment can approach zero. According to the other method, an impulse response wave is reproduced by linear predictive coding (LPC) of the one pitch wave which has been cut out, and this impulse response wave is used as the pitch wave segment. However, in the above methods, the ends of the pitch wave segment are not sufficiently close to zero and distortion thus remains in the pitch wave segment, resulting in variations in the tone.

SUMMARY OF THE INVENTION

Therefore, it is an object of the present invention to provide a voice synthesizing device which is effective to produce a synthetic voice with no sound quality distortion through a simple process to connect the wave segments.

In order to achieve the aforementioned objective, a voice synthesizing device of the present invention for compiling wave segments such as pitch wave segments in speech to synthesize speech is characterized by the provision of a connection type memory for storing a connection type descriptive of the connection state of that point where said wave segments are connected; and a wave segment connector which, when said wave segments are connected, connects the end sampling point and the lead sampling point of the wave segments with a conventional sampling period, or with a conventional sampling period compressed or expanded by only ½ of the sampling period according to the connection type stored in said connection type memory.

Thus, when voice wave segments are compiled to synthesize a voice, the connection type stored in the connection type memory is referenced. According to the referenced connection type, the end and leading sampling points of the wave segments are connected with a conventional sampling period, or with a conventional sampling period compressed or expanded by only ½ of the sampling period so that said wave segments are connected smoothly to provide a synthesized voice wave.

BRIEF DESCRIPTION OF THE DRAWINGS

FIG. 5*a*, 5*b*, and FIG. 5*c* are explanatory diagrams showing the wave types and their connection methods;

DETAILED DESCRIPTION OF THE INVENTION

Figure 1:
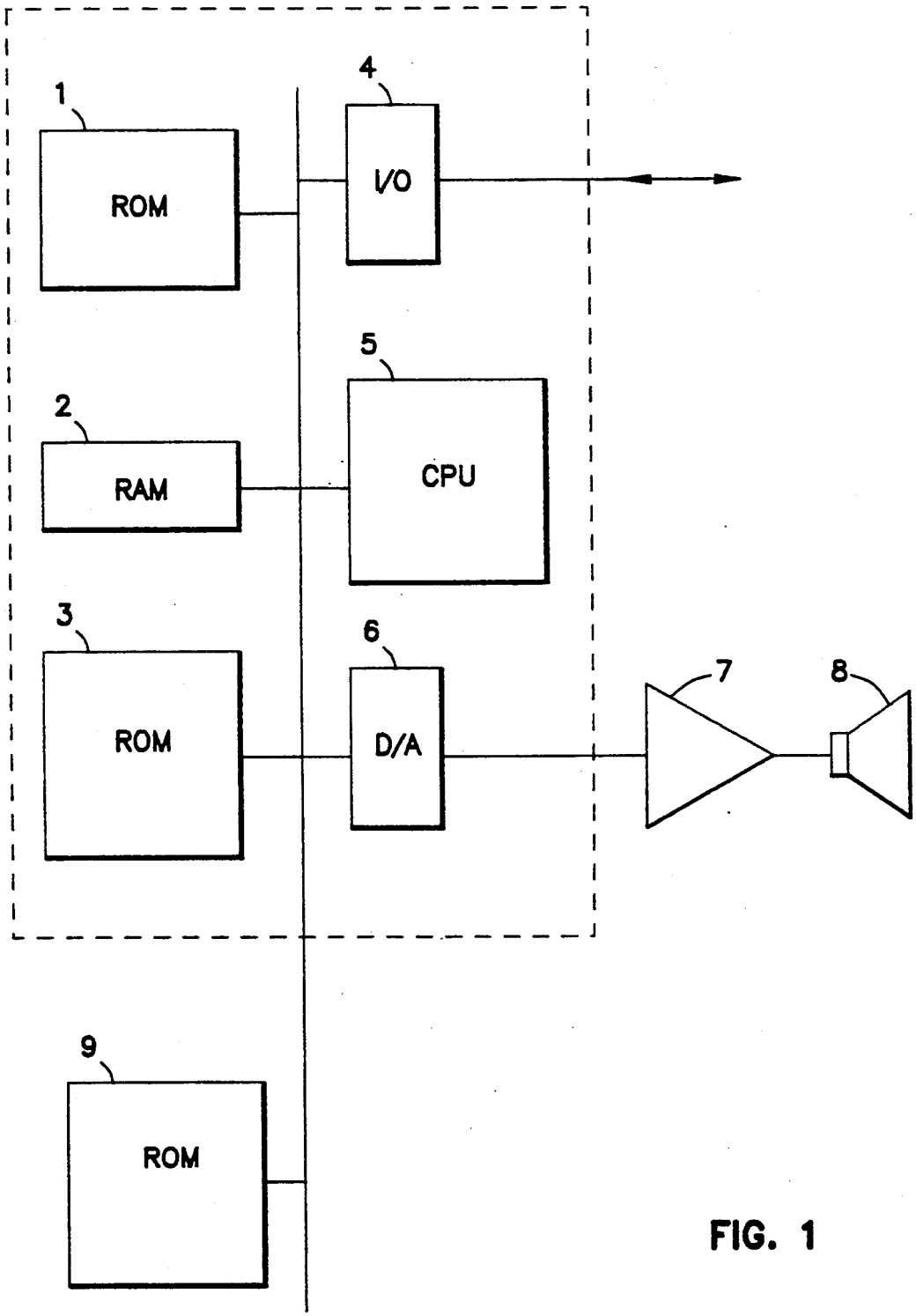
FIG. 1 is a block diagram of a preferred embodiment of a voice synthesizing device according to the present invention.

A first preferred embodiment of the present invention will now be described with reference to FIG. 1 which shows a block diagram of a voice synthesizing device according to the present invention.

Reference number 1 is a control ROM (read-only memory) which stores a control program used by CPU (central processing unit) 5 for voice synthesis; reference numeral 2 is a RAM (random access memory) used as a work memory during voice synthesis; reference numeral 3 is a data ROM used to store voice coding data; reference numeral 4 is an I/O interface through which input/output signals pass at the start of voice synthesis and other processes; reference numeral 6 is a D/A converter used for digital-to-analog conversion of voice wave data synthesized under the control of CPU 5; and reference numeral 7 is an amplifier which amplifies an input analog voice wave and outputs it to a loudspeaker 8.

The control ROM 1, RAM 2, data ROM 3, I/O interface 4, CPU 5, and D/A convertor 6, all used in the voice synthesizing device of the above construction, can be integrated together on a single chip. It is also possible to employ an external data ROM 9 for storing voice coding data for systems expansion.

When a start signal necessary to initiate the voice synthesis is input to a voice synthesizing device of the above construction from an external source through I/O interface 4, CPU 5 begins the voice synthesizing operation based on the control program stored in the control ROM 1. Thus, a voice synthesis wave data is generated by CPU 5 based on the voice coding data stored in the data ROM 3. The generated voice synthesis wave data is converted to an analog signal by D/A convertor 6, then amplified by amplifier 7 and is finally outputted as a synthesized voice from the loudspeaker 8.

As described below, the voice synthesizing device according to the present invention generates a synthesized voice free of distortion in the pitch wave rise by connecting wave segments such as pitch wave segments or quasi-voice wave segments to generate the synthesized voice.

According to a first method as shown in FIG. 5(*a*), when the time axis zero cross point of the interpolated waveform for the end sampled value of the preceding pitch wave segment and the time axis zero cross point of the interpolated waveform for the top sampled value of the following pitch wave segment are both within the range P2 when the waves are connected due to the connection of similar waves of type (1) or of dissimilar waves of waves of type (1) and type (3) as shown in FIG. 4(*a*) and FIG. 4(*c*), and when the time axis zero cross point of the interpolated waveform for the end sampled value of the preceding pitch wave segment and the time axis zero cross point of the interpolated waveform for the top sampled value of the following pitch wave segment are both within the range P1 when the waves are connected due to the connection of similar waves of wave type (2) or dissimilar waves of wave type (2) and type (4), the end sampled value and top sampled value of the pitch wave segments are output at the conventional sampling point and the pitch wave segments are connected. Then, the interpolated values between the end sampled value and the top sampled value (indicated by a solid triangle) are computed at a point equal to ½ sampling interval Ts and are outputted so that the two pitch wave segments can be connected smoothly. Hereinafter the connection of such pitch wave segments as just described shall be referred to as connection type 0*a*.

As shown in FIG. 5(*b*), when the time axis zero cross point of the interpolated waveform for the end sampled value of the preceding pitch wave segment is within the range P1 and the time axis zero cross point of the interpolated waveform for the top sampled value of the following pitch wave segment is within the range P2 when the waves are connected due to the connection of dissimilar waves of type (2) and type (1) or waves of type (2) and type (3), the wave segments are not connected at the conventional sampling point; the conventional sampling interval between the end and top sampled values is compressed by one-half and is then outputted to connect the pitch wave segments. Hereinafter the connection of such pitch wave segments as just described will be referred to as connection type 1*a*.

As shown in FIG. 5(*c*), when the time axis zero cross point of the interpolated waveform for the end sampled value of the preceding pitch wave segment is within the range P2 and the time axis zero cross point of the interpolated waveform for the top sampled value of the following pitch wave segment is within the range P1 when the waves are connected due to the connection of dissimilar waves of type (1) and type (2) or of waves of type (1) and type (4), the wave segments are not connected at the conventional sampling point; the conventional sampling interval between the end and top sampled values is expanded by one-half and is then outputted to connect the pitch wave segments. The period between the end and top sampled values of the pitch wave segments is interpolated as follows.

Specifically, assuming the end sampled value of the preceding pitch wave segment is $|x1|$ and the top sampled value of the following pitch wave segment is $|x2|$, if $|x1| > |x2|$, the interpolated value $x1/2$ is computed following the end sampled value $|x1|$ (specifically, the higher peak value), and is then outputted at intervals of Ts/2. Next, the period between this interpolated value $x1/2$ and the top sampled value $|x2|$ (specifically, the lower peak value) is interpolated and is then outputted. Hereinafter the connection of such pitch wave segments as just described shall be referred to as connection type 2-(*a*). Furthermore, if $|x1| < x2$, the interpolated value x2/2 of the prior top sampled value |x2| is computed and is then outputted at intervals of Ts/2. Next, the period between this interpolated value x2/2 and the top sampled value |x1| (specifically, the lower peak value) is interpolated and is then outputted. Hereinafter the connection of such pitch wave segments as just described shall be referred to as connection type 2-(*b*).

Figures 6A, 6B, 6C, 6D:
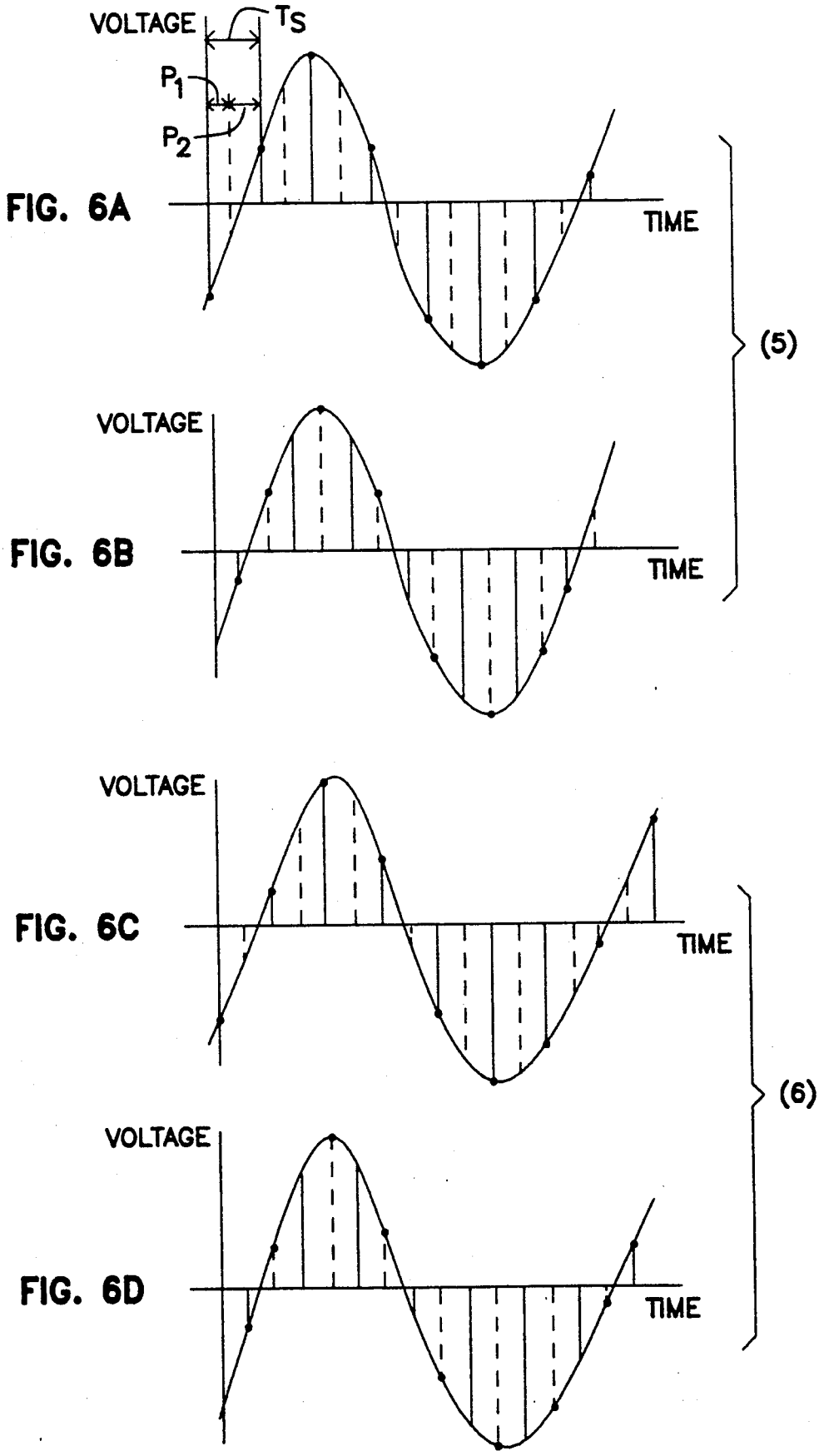
FIG. 6*a*, FIG. 6*b*, FIG. 6*c* and FIG. 6*d* are explanatory diagrams showing wave types according to an alternative embodiment of the present invention.

According to a second method, sampling is performed at a cycle twice (twice the frequency) that defined by the Nyquist theorem. Whether at an even-numbered sampling point or an odd-numbered sampling point, the sampling data used for voice synthesis is resampled at the standard Nyquist theorem cycle from the sampling point which is nearest the pitch segment rise. This wave is illustrated in FIG. 6(*a*)-FIG. 6(*d*). Here, the even-numbered sampling points are the sampling points (those shown by a solid line in FIG. 6(*a*)-FIG. 6(*d*)) occurring in the Nyquist theorem cycle, and the odd-numbered sampling points (those shown by a dotted line in FIG. 6*a*-FIG. 6(*d*)) are the sampling points occurring between even-numbered sampling points. In this case, sampling data obtained at the sampling points indicated by a double circle are the sampled values (which are hereinafter referred to as object samples) which will be the object of voice synthesis. These segments may be either wave type (1) or type (2).

Figure 7A:
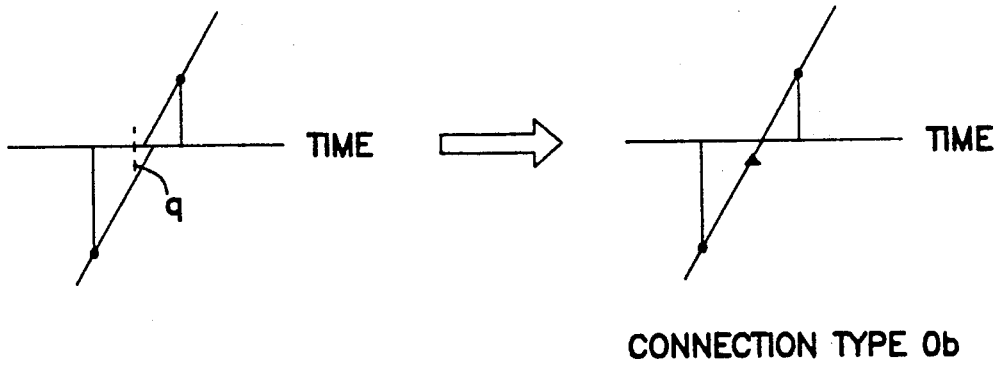
FIG. 7*a* and FIG. 7*b* are explanatory diagrams showing the wave types and their connection methods according to the alternative embodiment of the present invention.
Figure 7B:
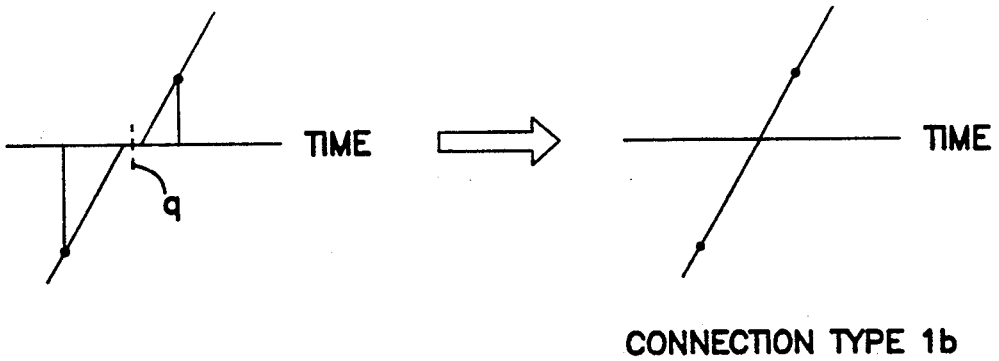

As shown in FIG. 7(*a*), when the time axis zero cross point of the interpolated waveform for the end sampled value which will be the object of voice synthesis for the preceding pitch wave segment (hereinafter referred to as the end object sample) and the time axis zero cross point of the interpolated waveform for the leading object sample of the following pitch wave segment are both within the range P2 due to the connection of similar waves of type (5) or dissimilar waves of type (5) and type (6), the end object peak which is the object of voice synthesis and the leading object sample are outputted at the sampling point which will be the object of voice synthesis to connect the pitch wave segments. Then, at the half point of the object sampling period, the end sampled value q of the preceding pitch wave segment is outputted as the interpolated value so that the two pitch wave segments can be connected smoothly. Hereinafter, connection of such pitch wave segments will be referred to as connection type 0*b*.

As shown in FIG. 7(*b*), when the time axis zero cross point of the interpolated waveform for the end object sample of the preceding pitch wave segment is within the range P1 and the time axis zero cross point of the interpolated waveform for the leading object sample of the following pitch wave segment is within the range P2 due to the connection of similar waves of type (6) or dissimilar waves of type (6) and type (5), the pitch wave segments are not connected at the sampling point which is the object of voice synthesis; the period between the end object sample and the leading object sample of the pitch wave segments is compressed by one-half and is then outputted to connect the pitch wave segments. Hereinafter, connection of such pitch wave segments will be referred to as connection type 1*b*.

Figure 2:
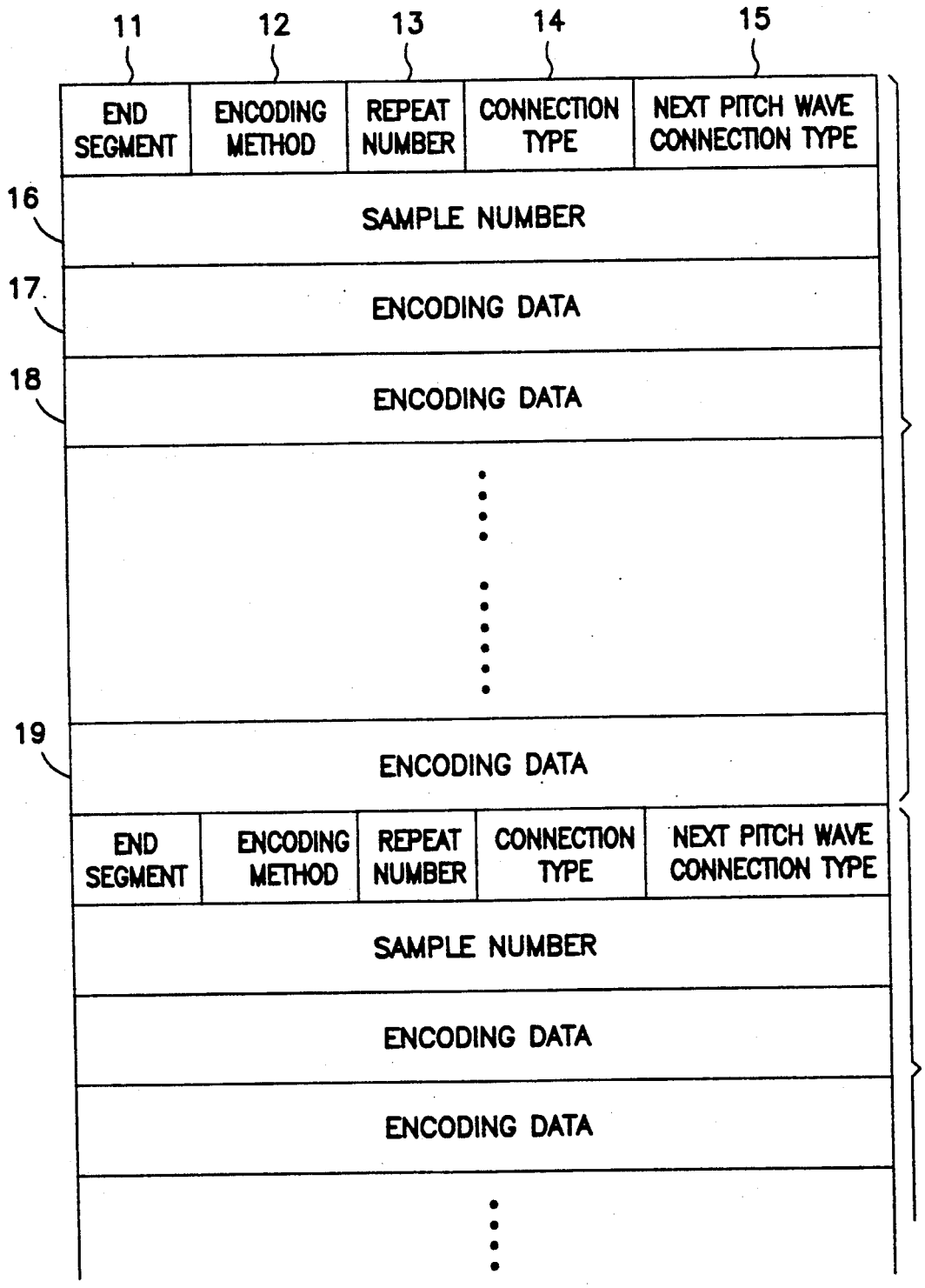
FIG. 2 is a diagram showing the format of storage of pitch wave segment data in a read-only memory (ROM)

FIG. 2 shows one example of the data format when, for example, the pitch wave segments are analyzed and the resulting pitch wave segment data is stored in ROM 3 (see FIG. 1). The illustrated data format is comprised of encoding data of multiple pitch wave segments, each of said encoding data for each pitch wave segment including interpolation data and voice data. The interpolation data consists of end segment data 11 identifying whether the pitch wave segment is the last pitch wave segment or not, encoding method data 12 identifying the method used to encode the sampled data of the pitch wave segment, repeat number data 13 telling how many times the pitch wave segment was repeated, connection type data 14, as shown in FIG. 5 and FIG. 7, for use when the same pitch wave segment is repeated, and connection type data 15 (hereinafter referred to as a next pitch wave segment connection type) for when the given pitch wave segment is connected to the next adjacent pitch wave segment. The voice data includes a sample number data 16 specifying the number of encoded datum included in the pitch wave segment, and a series of multiple encoded data 17 to 19 for each sampling point used in voice synthesis. This encoded data is stored as a bit string according to the encoding method (e.g., pulse code modulation (PCM) or adaptive differential pulse code modulation (ADPCM)) stored in the encoding method data 12 for the interpolation data.

Figure 3:
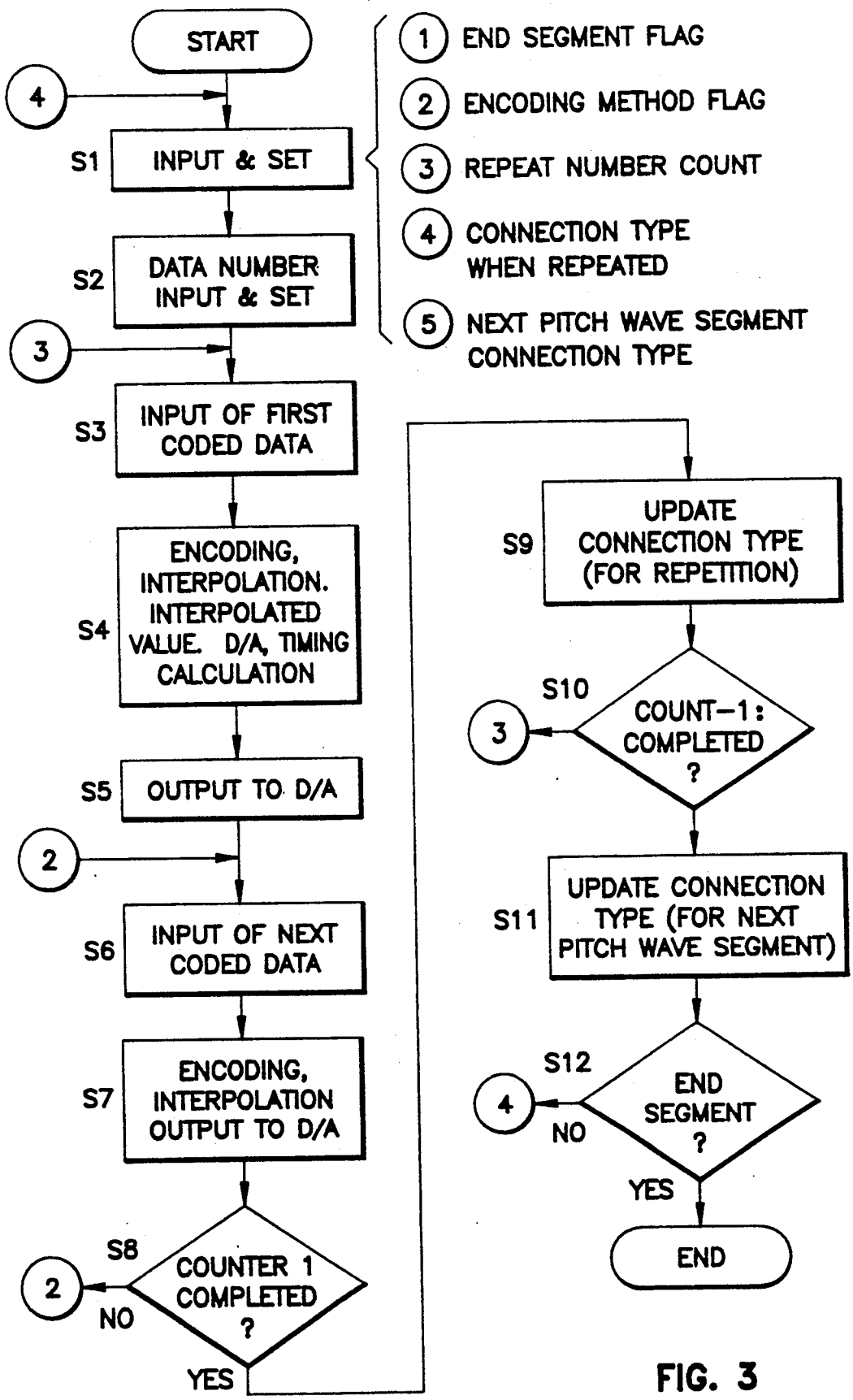
FIG. 3 is a flow chart showing the sequence of operation for the voice synthesizing operation.
Figure 4A:
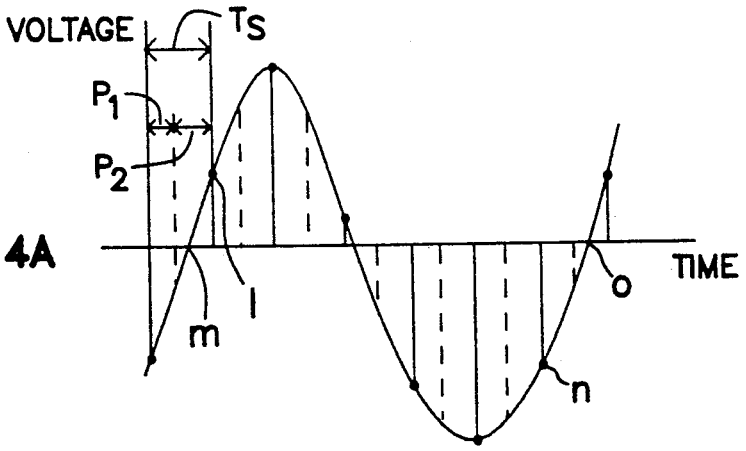
FIG. 4*a*, FIG. 4*b*, FIG. 4*c* and FIG. 4*d* are descriptive drawings of the wave types.
Figure 4B:
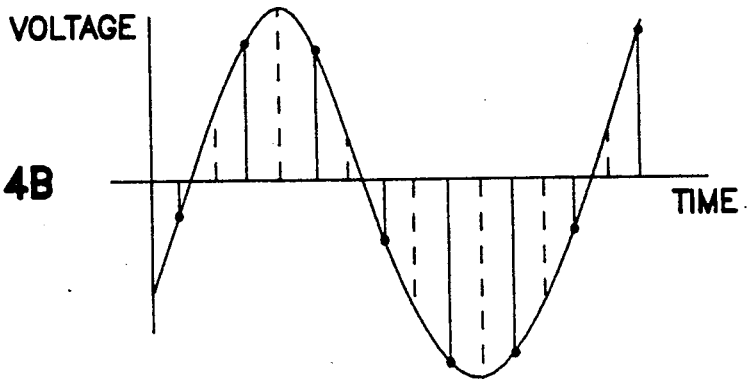
Figure 4C:
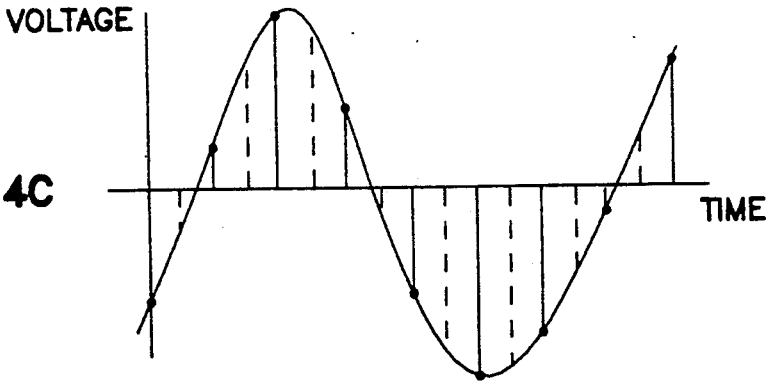
Figure 4D:
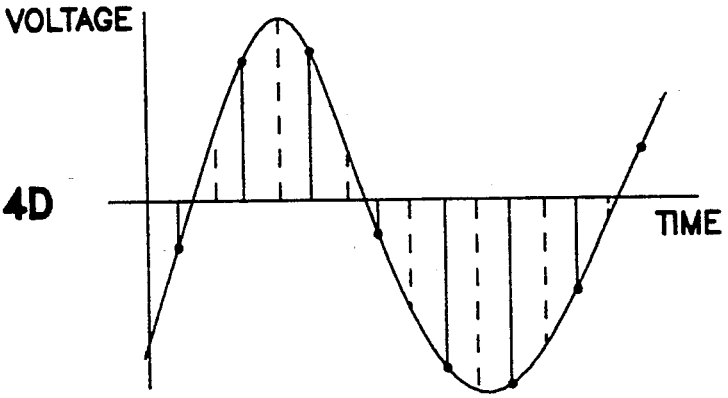

Referring now to the flow chart of FIG. 3, the voice synthesizing operation whereby pitch wave segments which are wave segments are connected and a voice is synthesized by the methods 1 and 2 described above will be described in detail below.

At step S1, 1 byte of interpolation data is read from the pitch wave segment data stored in the data ROM 3 according to the format shown in FIG. 2, and the byte is divided into the end segment data 11, the encoding method data 12, the repeat number data 13, the connection type data 14, and the next pitch wave segment connection type 15. Based on the obtained information, the end segment data flag, encoding method flag, repeat counter, repeat connection type, and next pitch wave segment connection type are each set in RAM 2. RAM 2 has an area for storing the repeat connection type for wave segment connection and a pitch wave segment connection type for wave segment connection, and the repeat connection type of the preceding pitch wave segment data and the next pitch wave segment connection type are both set therein.

At step S2, sample number data 16 specifying the encoded datum number of one pitch wave segment is read from the data ROM 3, and this number is set in RAM 2 as the sample number count.

At step S3, the first coded datum is read from data ROM 3.

At step S4, the first coded datum is decoded according to the encoding method set in the encoding method flag of RAM 2, and the top sampled value of the pitch wave segment is computed. The interpolated value of the period between this top sampled value and the following sampled value (based on the second encoded datum) is then computed. Next, the interpolation processing required for connection with the preceding pitch wave segment is then executed according to the next pitch wave segment connection type of the preceding pitch wave segment data set in the repeat connection type for pitch wave segments in RAM 2. Furthermore, the timing of the output of the computed the top sampled value to the D/A convertor 6 (if connection type 0*a* and 0*b*, the normal timing is outputted; if connection type 1*a* and 1*b*, the timing of a sampling cycle advanced by one-half is outputted; if connection type 2*a* and 2*b*, the timing of a sampling cycle delayed by one-half is output) is computed.

At step S5, the top sampled value computed at step S4 and the output timing of the preceding and following interpolated values computed in step S4 are outputted to D/A convertor 6.

In other words, it is interpolated according to the four connection types shown in FIG. 5 whether the period between the end sampled value of the preceding pitch wave segment and the top sampled value of the current pitch wave segment is expanded or compressed by one-half sampling cycle, and then D/A converted.

At step S6, the next encoded data (second encoded datum) is read from data ROM 3.

At step S7, the next encoded datum is decoded according to the encoding method, and the next sampled value is computed. Then, the interpolated value of the period to the next sampled value is computed. The computed sampled value and the interpolated value are outputted to D/A convertor 6 at the normal timing (specifically, the normal sampling point).

At step S8, the sample counter is decremented by 1, and it is determined based on this value whether the processing of the encoded data of the current pitch wave segment has been completed or not. If the result is that all processing has been completed, the flow advances to step S9; if not, the flow returns to step S6; and in both cases processing of the next encoded data is executed.

At step S9, the repeat connection type of the preceding pitch wave segment data set at the repeat connection type for pitch wave segments in RAM 2 is reset to the repeat connection type of the current pitch wave segment data set in the repeat connection type in RAM 2.

At step S10, the repeat counter in RAM 2 is decremented by 1, and it is determined based on this value whether all repetitions of the current pitch wave segment are completed or not. If the result is completion, the flow advances to step S11; if not, the flow returns to step S3, the first encoded data of the current pitch wave segment is again inputted, and repeat processing is executed.

At step S11, the next pitch wave segment connection type of the preceding pitch wave segment data set in the next pitch wave segment connection type for pitch wave segments in RAM 2 is reset to the next pitch wave segment connection type of the current pitch wave segment data set in the next pitch wave segment connection type of RAM 2.

At step S12, the end segment data flag in RAM 2 is referenced to determine whether the current pitch wave segment is the end segment. If the result is "yes", the voice synthesis operation is completed; if "no", the flow returns to step S1, the next pitch wave segment data is read, and processing of the next pitch wave segment data begins.

Thus, wave segment connection types are categorized by the combination of the connections of the pitch wave segments of differing wave types. Based on the connection type, the period between the end sampling point and the leading sampling point of connected pitch wave segments may be compressed or expanded by one-half of the normal sampling period, or the normal sampling period may be used to connect the wave segments. Therefore, pitch wave segments can be connected smoothly by a simple operation without producing any phase shift in the connection of the pitch wave segments. In other words, in a voice synthesizing device according to the present invention, distortion does not occur in the rise of the pitch wave segment and sound quality deterioration is not produced.

In the foregoing preferred embodiment as described above, a pitch wave segment is used as the wave segment, but the present invention shall not be so limited, and a voice wave segment conforming to a pitch wave segment may also be used.

As will be known from the foregoing description of the present invention, no phase shifts occur in the connection of wave segments in the synthesized voice generated by the voice synthesizing device according to the present invention This advantage results due to the voice synthesizing device being provided with the wave segment connector which stores a connection type which expresses the type of connection between the wave segments in the voice in a connection type memory. Further, when said wave segments are connected to synthesize a voice, the end and leading sampling points of said wave segments are connected by a normal sampling period or by a sampling period compressed or expanded by one-half period depending upon the connection type stored in the connection type memory.

As a result, the period between pitch wave segments can be interpolated and the segments smoothly connected by a simple operation. Therefore, according to the present invention, voice synthesis free of distortion in the rise of connected wave segments and with no deterioration of sound quality can be achieved.

Although the present invention has been fully described in connection with the preferred embodiments thereof with reference to the accompanying drawings, it is to be noted that various changes and modifications are apparent to those skilled in the art. Such changes and modifications are to be construed as included within the scope of the present invention defined by the appended claims, unless they depart therefrom.

What is claimed is:

1. A device used with a voice synthesizing device which connects wave segments such as pitch wave segments in speech input to the device, comprising:

a connection type memory for storing a plurality of wave segment connection types;

means for assigning a connection type to a connection between a preceding wave segment and a following wave segment; and a wave segment connector which, when said wave segments are connected, connects an end sampling point of the preceding wave segment and a lead sampling point of the following wave segment utilizing a preferred sampling period between the end sampling point of the preceding wave segment and the lead sampling point of the following wave segment with an interval determined by the connection type assigned to the connection between the preceding wave segment and the following segment.

2. A device according to claim 1 wherein said preferred sampling period is selected from the group consisting of a predetermined sampling time period, three-halves a predetermined sampling time period, and one half of a predetermined sampling time period.

3. A device used with a voice synthesizing device for connecting wave segments, comprising:

a) a connection type memory for storing a plurality of preferred connection types for wave segments, said connection types each representing a connection of an interpolated waveform for an end sampled value of a preceding wave segment of a particular type with an interpolated waveform for a lead sampled value of a following wave segment of a particular type, each of said preferred connection types determining a preferred sampling period for use during connection of said wave segments;

b) means for assigning a connection type to a connection between a preceding wave segment and a following wave segment by interpolating a time axis zero cross point for said interpolated waveform for said end sampled value of said preceding wave segment and a time axis zero cross point for said interpolated waveform for said lead sampled value of said following wave segment and c) a wave segment connector providing connection of said preceding and following wave segments using one of said preferred sampling periods as determined by the connection type assigned to the connection between said preceding and following wave segments.

4. A device according to claim 3 wherein said preferred sampling period has one of the following three values: a predetermined sampling time period, three-halves a predetermined sampling time period, and one half of a predetermined sampling time period.

5. A device according to claim 3 wherein said plurality of preferred connection types comprises:

a) a first connection type in which both the time axis zero cross point of said interpolated waveform for said lead sampled value of said following wave segment and the time axis zero cross point of said interpolated wave segment for said end sampled value of said preceding wave segment are located within a second half of a predetermined sampling time period;

b) a second connection type in which both the time axis zero cross point of said interpolated waveform for said lead sampled value of said following wave segment and the time axis zero cross point of said interpolated wave segment for said end sampled value of said preceding wave segment are located within a first half of a predetermined sampling time period;

c) a third connection type in which the time axis zero cross point of said interpolated waveform for said lead sampled value of said following wave segment is located within a second half of a predetermined sampling period and the time axis zero cross point of said interpolated waveform segment for said end sampled value of said preceding wave segment is located within a first half of a predetermined sampling time period; and d) a fourth connection type in which the time axis zero cross point of said interpolated waveform for said lead sampled value of said following wave segment is located within a first half of a predetermined sampling time period and the time axis zero cross point of said interpolated wave segment for said end sampled value of said preceding wave segment is located within a second half of a predetermined sampling time period.

6. A device for connecting wave segments according to claim 3 wherein said wave segments comprise pitch wave segments.

7. A device for connecting wave segments according to claim 3 wherein said wave segments comprise voice wave segments.

8. A device for connecting wave segments according to claim 7 wherein said voice wave segments comprise quasi-voice wave segments.

9. An improved voice synthesizing device of the type in which a read only memory device stores a control program for use by a central processing unit for voice synthesis, a random access memory device is used as a work memory during voice synthesis, a data read only memory device is used to store voice coding data, an input/output interface is provided through which input/output signals pass at the start of voice synthesis and using other processes, a digital to analog convertor is used for conversion of voice wave data synthesized under the control of the central processing unit, and in which an amplifier amplifies an input analog voice wave and outputs to a loudspeaker, wherein the improvement comprises:

a) a connection type memory for storing a plurality of preferred connection types for wave segments, said connection types each representing a connection of an interpolated waveform for an end sampled value of a preceding wave segment of a particular type with an interpolated waveform for a lead sampled value of a following wave segment of a particular type, each of said preferred connection types determining a preferred sampling period for use during connection of said wave segments;

b) means for assigning a connection type to a connection between a preceding wave segment and a following wave segment by interpolating a time axis zero cross point for said interpolated waveform for said end sampled value of said preceding wave segment and a time axis zero cross point for said interpolated waveform for said lead sampled value of said following wave segment;

c) a wave segment connector providing connection of said wave segments using one of said preferred sampling portions as determined by the connection type assigned to the connection between said wave segments to provide a synthesized voice output independent of any distortion in the pitch wave rise; and d) means for electrically interconnecting said connection type memory and said wave segment connector with the control read only memory, the input/output interface, the central processing unit, the data read only memory, and the digital to analog convertor.

10. A method of smoothly connecting wave segments for use in creating a synthesized voice free of distortion in a pitch wave rise, comprising the steps of:

a) interpolating between sampled values to determine interpolated values to produce an interpolated waveform;

b) identifying a time axis zero cross point for an interpolated waveform of an end sampled value of a preceding wave segment;

c) determining a time axis zero cross point for an interpolated waveform of a lead sampled value of a following wave segment;

d) classifying the time axis zero cross point of the preceding wave segment and the following wave segment with a connection type memory to select a preferred wave segment connection type;

e) selecting a preferred wave segment connection type and a preferred sampling period from a plurality of connection types and sampling periods as determined by said wave types; and f) connecting said preceding wave segment with said following wave segment using said selected preferred wave segment connection type and said selected preferred sampling period to provide a synthesized voice independent of distortion in the pitch wave rise.

11. A method of smoothly connecting wave segments which can be used for creating a synthesized voice free of distortion in the pitch wave rise according to claim 10, wherein the step of selecting a preferred wave segment connection type and a preferred sampling period comprises the steps of:

a) categorizing the time axis zero cross points of each of the interpolated waveforms for the preceding wave segment and the following wave segment by determining which memory waveforms stored in a wave segment connection type memory are most similar to said interpolated waveforms; and b) interpolating between said end sampled value and said lead sampled value with the preferred sampling period corresponding to the preferred wave connection type, the sampling period selected from a group comprising a predetermined sampling time, three-halves a predetermined sampling time, and one half a predetermined sampling time.

* * * * *

UNITED STATES PATENT AND TRADEMARK OFFICE

CERTIFICATE OF CORRECTION

PATENT NO. : 5,111,505

DATED : May 5, 1992

INVENTOR(S) : Kitoh, Fujimoto

It is certified that error appears in the above-identified patent and that said Letters Patent is hereby corrected as shown below:

Column 1, lines 7 and 8; insert --BACKGROUND OF THE INVENTION-- (between lines 7 & 8) before "Field of the Invention".

Column 1, line 36; delete "an" after the word "shows".

Column 1, line 36; "shows" should read --show--.

Column 1, line 36; "example" should read --examples--.

Column 1, line 38; "shows" should read --show--.

Column 1, line 53; insert --the-- after the word "of".

Column 1, line 53; insert --or (interchangeably here throughout) lead-- after the word "top".

Column 1, line 64; insert --the-- after the word "of".

Column 1, line 66; insert --the-- after the word "of".

Column 1, line 1; insert --the-- after the word "of".

Column 1, line 3; insert --the-- after the word "of".

Column 8, line 10; insert --.-- after the word "invention".

UNITED STATES PATENT AND TRADEMARK OFFICE

CERTIFICATE OF CORRECTION

PATENT NO. : 5,111,505

DATED : May 5, 1992

INVENTOR(S) : Kitoh, Fujimoto

It is certified that error appears in the above-indentified patent and that said Letters Patent is hereby corrected as shown below:

Column 10, line 35, Claim 9; "portions" should read --periods--.

Signed and Sealed this

Thirtieth Day of November, 1993

Bruce Lehman

*Attest:*

BRUCE LEHMAN

*Attesting Officer*

*Commissioner of Patents and Trademarks*